US008779988B2

(12) United States Patent
Yang et al.

(10) Patent No.: US 8,779,988 B2
(45) Date of Patent: Jul. 15, 2014

(54) SURFACE MOUNT DEVICE MULTIPLE-BAND ANTENNA MODULE

(75) Inventors: Tsai-Yi Yang, Tainan (TW); Chia-Tsung Wu, Tainan (TW)

(73) Assignees: Cirocomm Technology Corp., Tainan (TW); Taoglas Group Holdings Limited, Wexford (IE)

( * ) Notice: Subject to any disclaimer, the term of this patent is extended or adjusted under 35 U.S.C. 154(b) by 219 days.

(21) Appl. No.: 13/351,211

(22) Filed: Jan. 16, 2012

(65) Prior Publication Data

US 2012/0182186 A1 Jul. 19, 2012

(30) Foreign Application Priority Data

Jan. 18, 2011 (TW) ..... 100101869 A

(51) Int. Cl.
*H01Q 5/00* (2006.01)
*H01Q 1/24* (2006.01)
*H01Q 9/42* (2006.01)

(52) U.S. Cl.
CPC ..... *H01Q 1/243* (2013.01); *H01Q 5/0058* (2013.01); *H01Q 9/42* (2013.01)
USPC ..... 343/700 MS; 343/702

(58) Field of Classification Search
CPC .... H01Q 1/243; H01Q 5/0058; H01Q 5/0055
USPC ..... 343/852, 700 MS
See application file for complete search history.

(56) References Cited

U.S. PATENT DOCUMENTS 6,323,811 B1 * 11/2001 Tsubaki et al. ..... 343/700 MS
2004/0246180 A1 * 12/2004 Okado ..... 343/700 MS
2007/0236394 A1 * 10/2007 Aoyama et al. ..... 343/700 MS
2008/0238803 A1 * 10/2008 Yang et al. ..... 343/848
2011/0043432 A1 * 2/2011 Ineichen et al. ..... 343/876

FOREIGN PATENT DOCUMENTS

CN 1485950 A 3/2004
CN 1518783 A 8/2004
CN 101308950 A 11/2008
CN 201994418 U 9/2011

OTHER PUBLICATIONS

China Official Action issued on Sep. 9, 2013.

* cited by examiner

*Primary Examiner* — Dameon E Levi
*Assistant Examiner* — Ricardo Magallanes
(74) *Attorney, Agent, or Firm* — Chun-Ming Shih; HDLS IPR Services

(57) ABSTRACT

A surface mount device multiple-band antenna module includes a substrate and a carrier. The substrate has a first grounding metal surface and a first micro-strip line on a side thereof. The first grounding metal surface has a second micro-strip line connected thereto. There is a space between the first micro-strip line and the second micro-strip line. The substrate has a second grounding metal surface on the other side thereof. The carrier is made of ceramic material with high dielectric constant, which has a first radiative metal portion, a second radiative metal portion and a third radiative metal portion. The carrier is electrically connected with the substrate. The joint of the first radiative metal portion and the second radiative metal portion is electrically connected to the first micro-strip line. The third radiative metal portion is electrically connected to the second micro-strip line. Thus, the multiple-band antenna module is obtained.

7 Claims, 10 Drawing Sheets

| | 700 MHz | 824 MHz | 960 MHz | 1710 MHz | 2170 MHz |
|---|---|---|---|---|---|
| Reture Loss | -3.98 | -11.66 | -5.57 | -10.39 | -6.38 |
| SWR | 4.20 | 1.73 | 3.02 | 1.76 | 2.88 |

FIG.8C

| peak gain parameter summary of the long term evolution antenna | | | | | | | | | | | |
|---|---|---|---|---|---|---|---|---|---|---|---|
| Band | GSM (MHz) | | | | | DCS (MHz) | | PCS (MHz) | | WCDMA (MHz) | |
| | 700 | 824 | 880 | 890 | 960 | 1710 | 1880 | 1850 | 1990 | 2110 | 2170 |
| Peak Gain (dBi) | -4.0 | 2.21 | 2.49 | 2.56 | 2.32 | 3.88 | 4.5 | 4.76 | 5.22 | 4.28 | 3.07 |
| Efficiency (%) | 40.09 | 66.97 | 70.48 | 68.10 | 63.76 | 70.35 | 70.32 | 71.97 | 82.60 | 67.04 | 58.29 |

FIG.9

SURFACE MOUNT DEVICE MULTIPLE-BAND ANTENNA MODULE

BACKGROUND OF THE INVENTION

1. Field of the Invention

This invention relates to an antenna, in particularly to a multiple-band antenna module having higher gain.

2. Description of Related Art

As wireless communication technology keeps developing, the trend in the portable electronic devices like laptop computer, mobile phone, personal digital assistant (PDA) is toward lighter and thinner. Therefore, the antenna in the portable electronic devices for transmitting and receiving electromagnetic wave signals has the need of downsizing or reforming to meet the trend.

The conventional multiple-band antenna such as a planar inverted-F antenna (PIFA) is generated from a two dimensional design. The PIFA can be provided from a printed circuit board (PCB) which has copper foil to be processed into a two dimensional shape, or can be provided as a three dimensional design from metal sheet forming processes.

The PIFA has the two dimensional planar-shaped copper foils on the PCB to provided dual or more than dual bands for transmitting and receiving electromagnetic waves. In order to meet the requirement of signal transmitting and receiving and to avoid miscoordination caused from environment, the antenna provided from PCB or metal sheet must has a sufficient size and the portable electronic device has to preserve sufficient space for the PIFA antenna. However, due to the size of the antenna, the portable electronic device is not easy to downsize to meet the trend.

SUMMARY OF THE INVENTION

The objective of the present invention aims to the above-mentioned problem and thus provides a surface mount device multiple-band antenna module, which arranges multiple antenna metal patterns on a ceramic material with high dielectric constant and is compact-sized.

For achieving the above-mentioned objective, the surface mount device multiple-band antenna module includes a substrate and a carrier. The substrate has a first surface and a second surface. The first surface has a first grounding metal surface and a first micro-strip line. An interval is formed between the first grounding metal surface and a first micro-strip line. The first grounding metal surface has a second micro-strip line connected thereto. The second micro-strip line is parallel to the first micro-strip line. A space is formed between the first micro-strip line and the second micro-strip line.

The carrier is electrically connected to the substrate and has a first radiative metal portion, a second radiative metal portion and a third radiative metal portion. The second radiative metal portion is electrically connected to the first radiative metal portion. The third radiative metal portion is not electrically connected to the first radiative metal portion and the second radiative metal portion.

The first micro-strip line is electrically connected to the joint of the first radiative metal portion and the second radiative metal portion. And the third radiative metal portion is electrically connected to the second micro-strip line.

BRIEF DESCRIPTION OF THE DRAWINGS

FIG. 8*c* shows a chart representing the frequency response of the present invention; and FIG. 9 shows a peak gain parameter summary of the long term evolution antenna of the present invention.

DETAILED DESCRIPTION OF THE INVENTION

Figure 1:
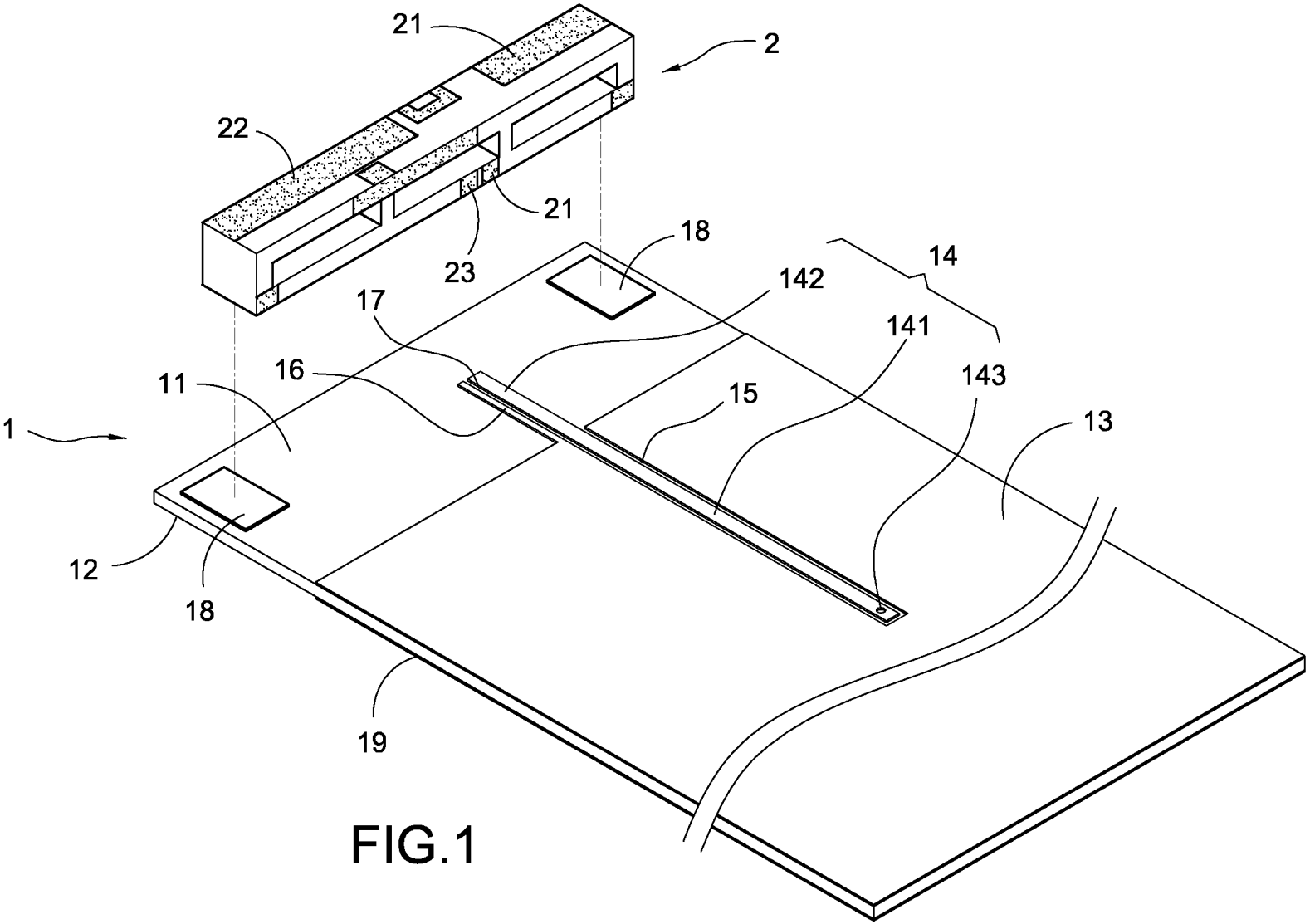
FIG. 1 shows an exploded view of the multiple-band antenna module of the present invention.
Figure 2:
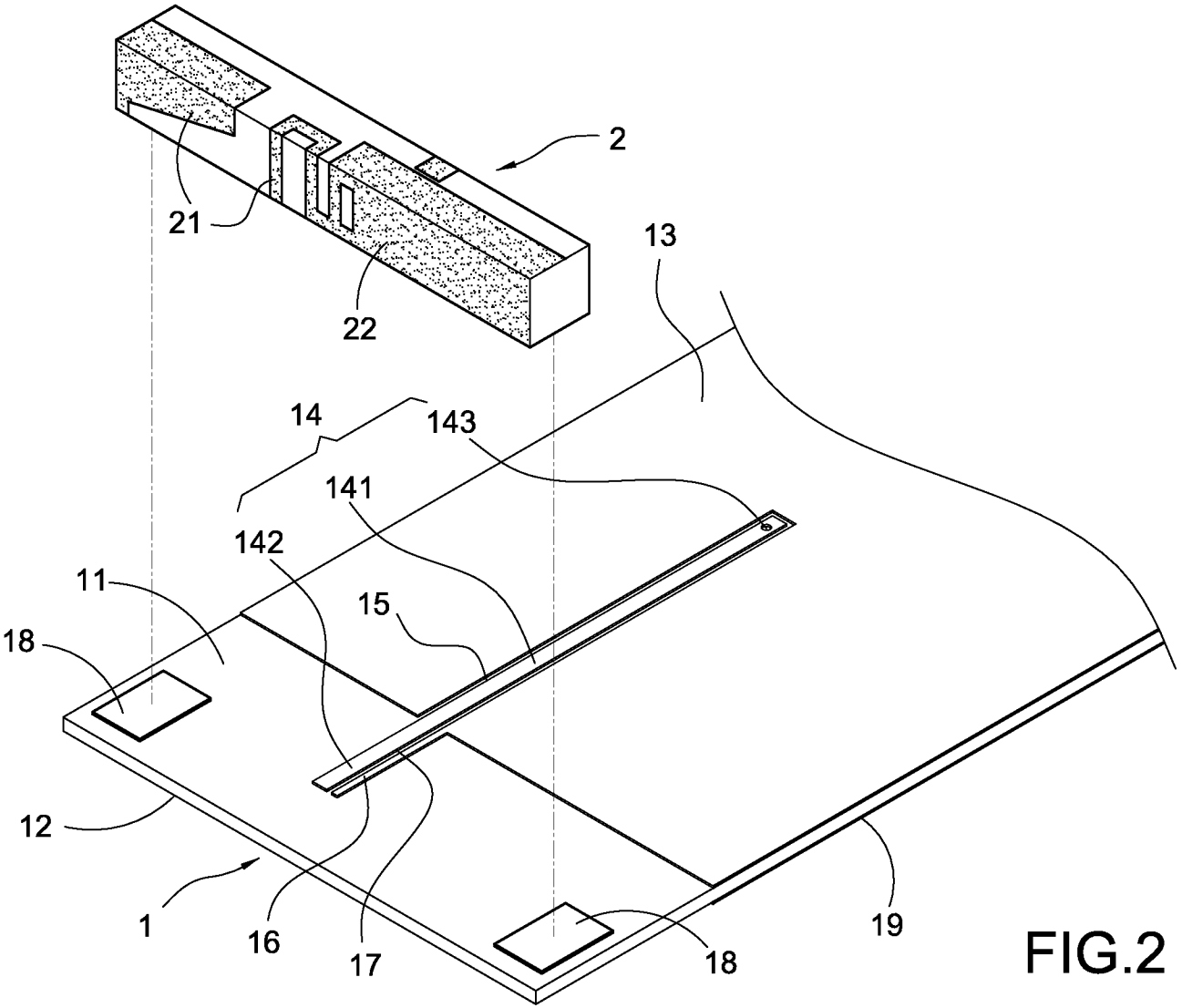
FIG. 2 shows another exploded view of the multiple-band antenna module of the present invention.
Figure 3:
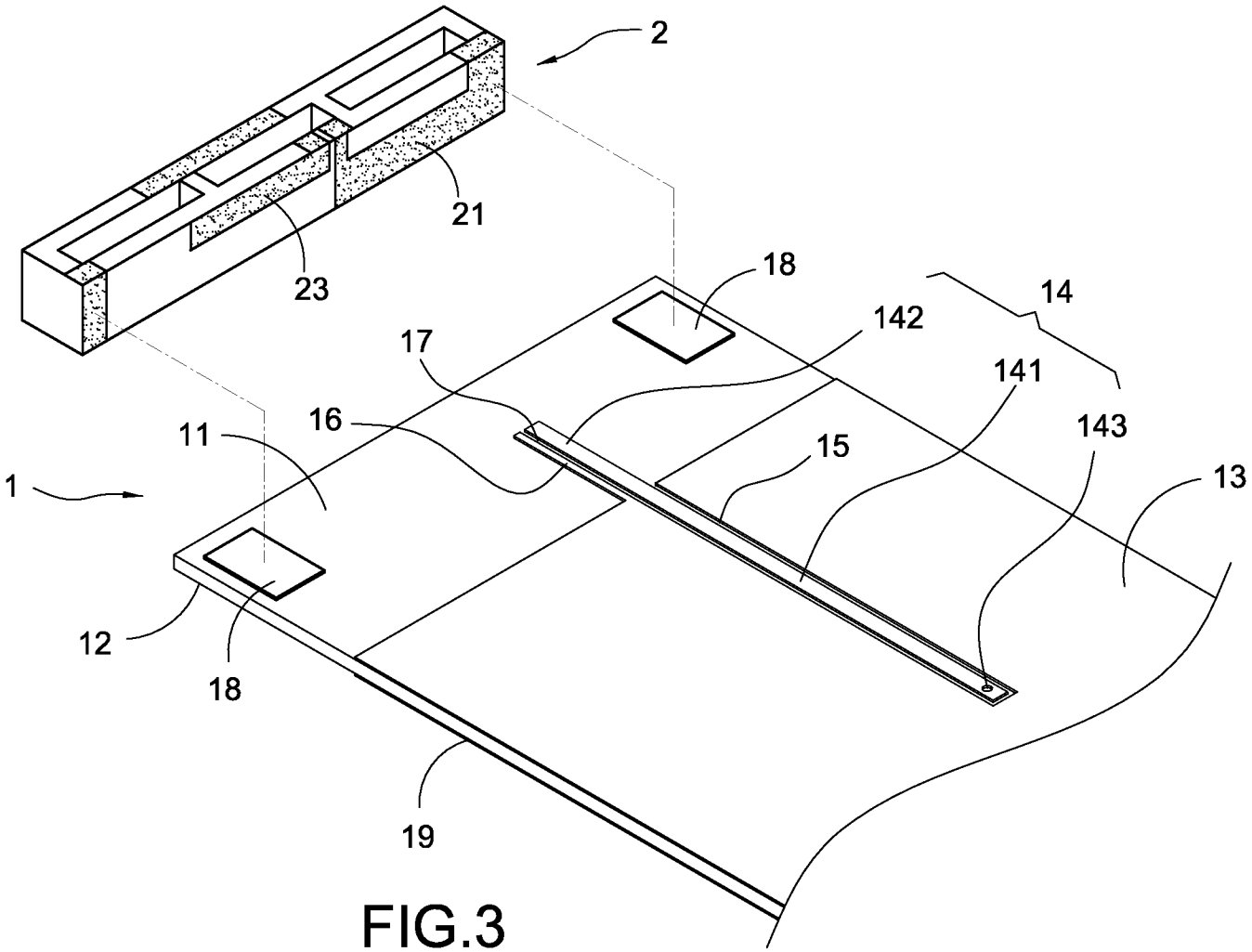
FIG. 3 shows yet another exploded view of the multiple-band antenna module of the present invention.

A detailed description of the present invention will be made with reference to the accompanying drawings.

As FIG. 1 to FIG. 4, the multiple-band antenna module of the present invention mainly includes a substrate 1 and a carrier 2.

The substrate 1 has a first surface 11 and a second surface 12. The first surface 11 has a first grounding metal surface 13 and a first micro-strip line 14. The first micro-strip line 14 has a front section 141 and a rear section 142. The front section 141 has a through hole 143. The front section 141 of the first micro-strip line 14 extends into the first grounding metal surface 13. An interval 15 is formed between the front section 141 and the first grounding metal surface 13. The first grounding metal surface 13 has a second micro-strip line 16 connected thereto. The second micro-strip line 16 is parallel to the rear section 142 of the first micro-strip line 14. A space 17 is formed between the rear section 142 of the first micro-strip line 14 and the second micro-strip line 16. The space 17 between the rear section 142 of the first micro-strip line 14 and the second micro-strip line 16 is used to adjust the capacitance therebetween and thus forms a high frequency resonance point on the first grounding metal surface 13 for increasing the bandwidth. Besides, the first surface 11 has two fixing points 18 which are used to connect with the first radiative metal portion 21 and the second radiative metal portion 22 of the carrier 2. The second surface 12 has a second grounding metal portion 19 for electrically connecting with a grounding portion of a connector of a coaxial cable (not shown).

The carrier 2 is of rectangular cuboid shape and is made of ceramic material with high dielectric constant. The carrier 2 has a first radiative metal portion 21, a second radiative metal portion 22 and a third radiative metal portion 23. The first radiative metal portion 21, the second radiative metal portion 22 and the third radiative metal portion 23 each has different rectangular or stripe patterns. And the rectangular or stripe patterns are arranged on at least one surface of the carrier 2. Thus, the antenna can be downsized. The second radiative metal portion 22 is electrically connected to the first radiative metal portion 21. The third radiative metal portion 23 is not electrically connected to the first radiative metal portion 21 and the second radiative metal portion 22. The carrier 2 is electrically connected to the substrate 1. The first radiative metal portion 21 and the second radiative metal portion 22 are electrically connected to the two fixing points 18 on the first surface 11 of the substrate 1. And the carrier 2 can be fixed on the first surface 11 of the substrate 1. Besides, the first micro-strip line 14 is electrically connected to the joint of the first radiative metal portion 21 and the second radiative metal portion 22, and the third radiative metal portion 23 is electrically connected to the second micro-strip line 16. Thus, the multiple-band antenna module is provided.

Figure 4:
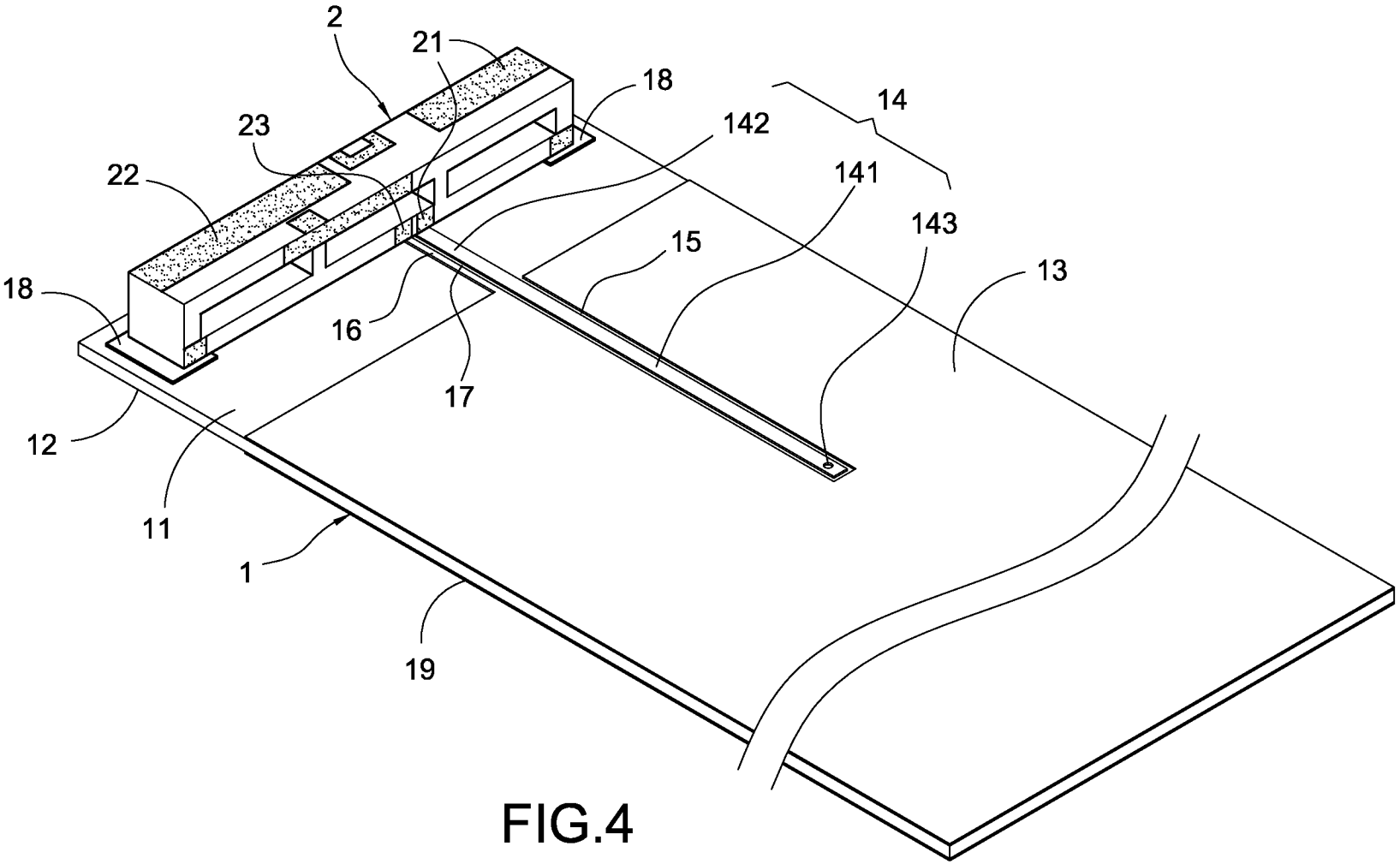
FIG. 4 shows a perspective view of the multiple-band antenna module of the present invention.
Figure 5:
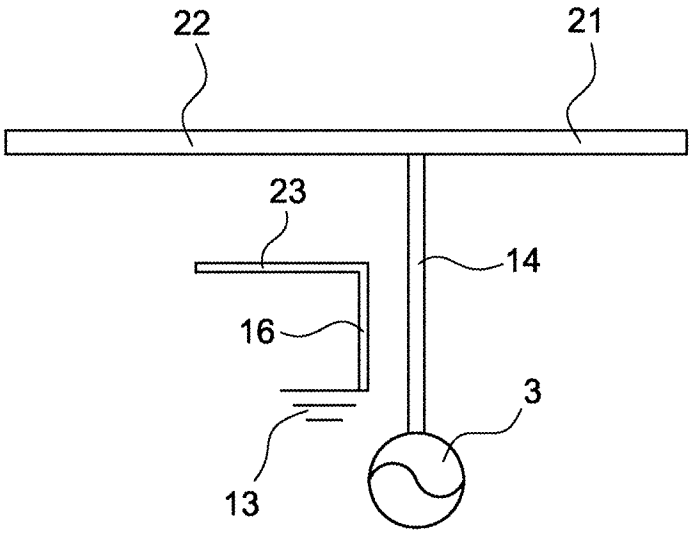
FIG. 5 shows a schematic view of the multiple-band antenna module of the present invention.

As FIG. 4 and FIG. 5 show, after the first radiative metal portion 21 and the second radiative metal portion 22 are electrically connected to the first micro-strip line 14, the first radiative metal portion 21 forms as a first antenna. The second radiative metal portion 22 forms as a second antenna. The third radiative metal portion 23 and the second micro-strip line 16 cooperatively form as a third antenna of the multiple-band antenna module.

When the signal source 3 inputs through the first micro-band line 14, and via the first radiative metal portion 21 and the second radiative metal portion 22 which form a structure including high and low frequency resonance branches. The width of the space 17 between the first radiative metal portion 21 and the second radiative metal portion 22 can be adjusted to fine tune the coupling capacitance, thus providing a high frequency resonance point by the first grounding metal surface 13, so as to increase the bandwidth.

Figure 6:
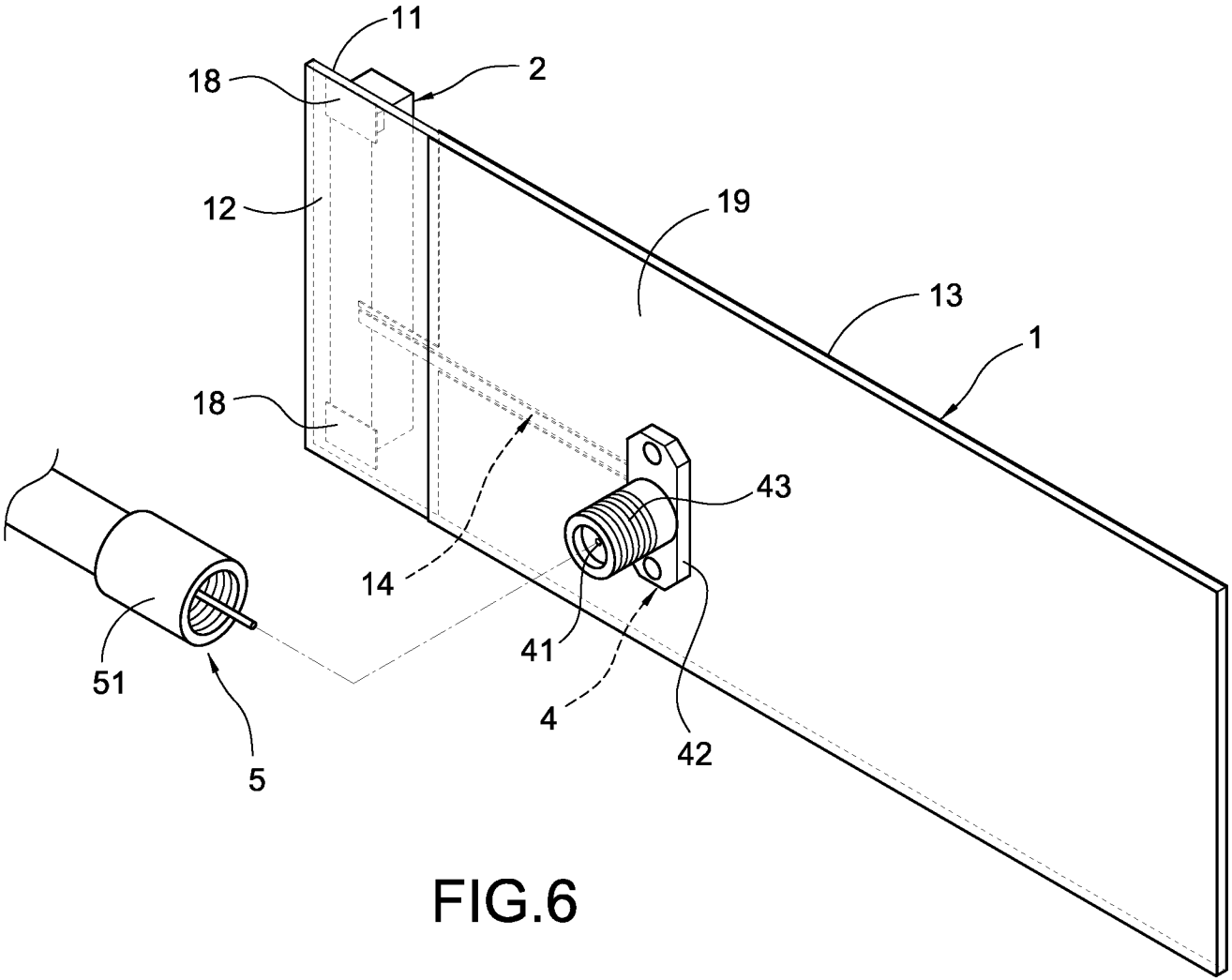
FIG. 6 shows a schematic view of the multiple-band antenna module of the present invention.
Figure 7:
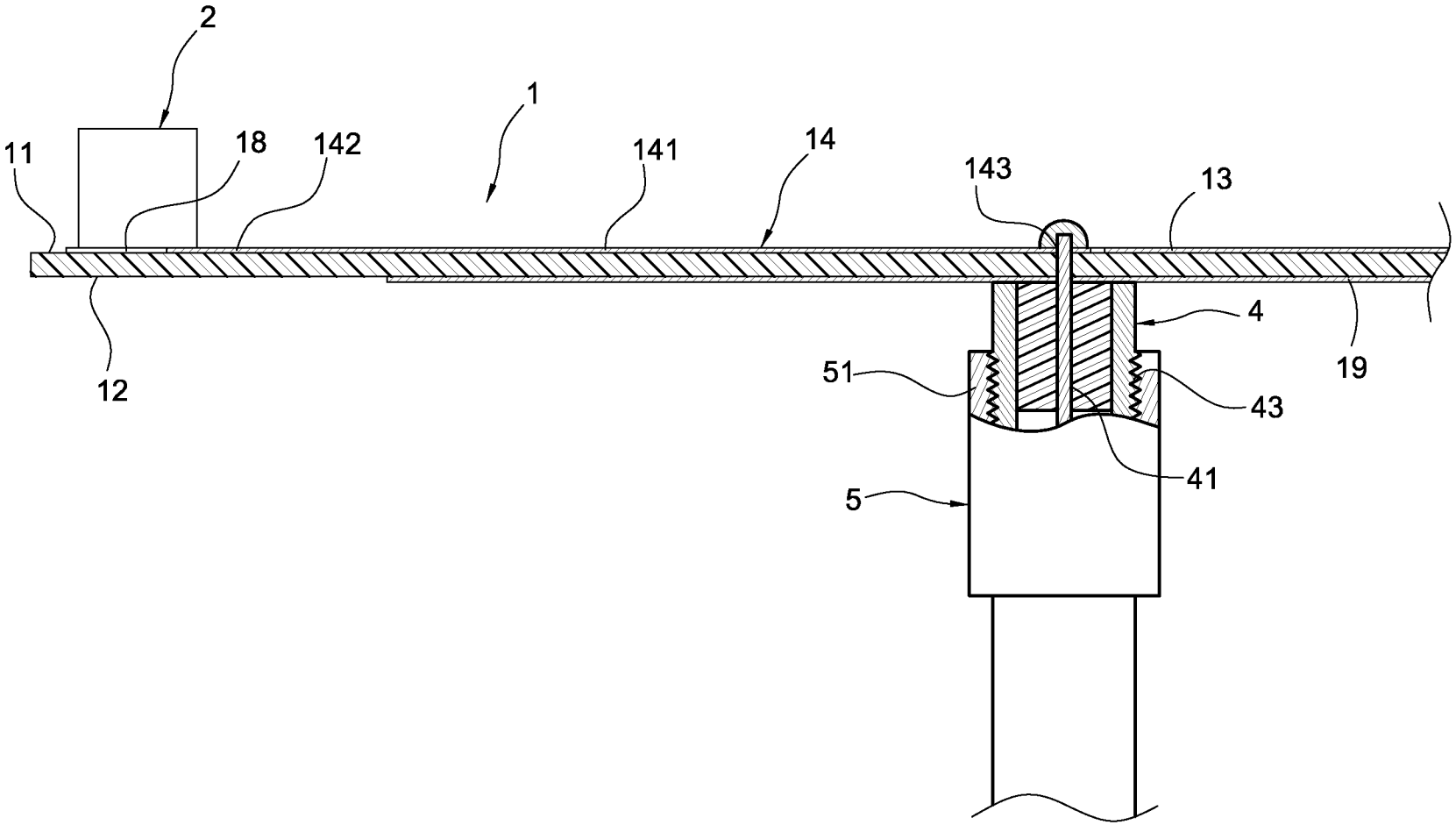
FIG. 7 shows a cross-sectional view of the multiple-band antenna module of the present invention.

FIG. 6 and FIG. 7 show a connector 4 having a shell 42 and a signal feeding probe 41 arranged inside the shell 42. The signal feeding probe 41 passes through the through hole 143 of the first micro-strip line 14 and electrically connects to the first micro-strip line 14. The shell 42 of the connector 4 is electrically connected to the second grounding metal surface 19.

When the multiple-band antenna module is in practical use, a connector 51 of the coaxial cable 5 can be connected to the connector 43 of the shell 42. The first radiative metal portion 21 and the second radiative metal portion 22 and the third radiative metal portion 23 can respectively used to receive signals of different frequency bands. The multiple-band antenna module is thus obtained.

Figure 8A:
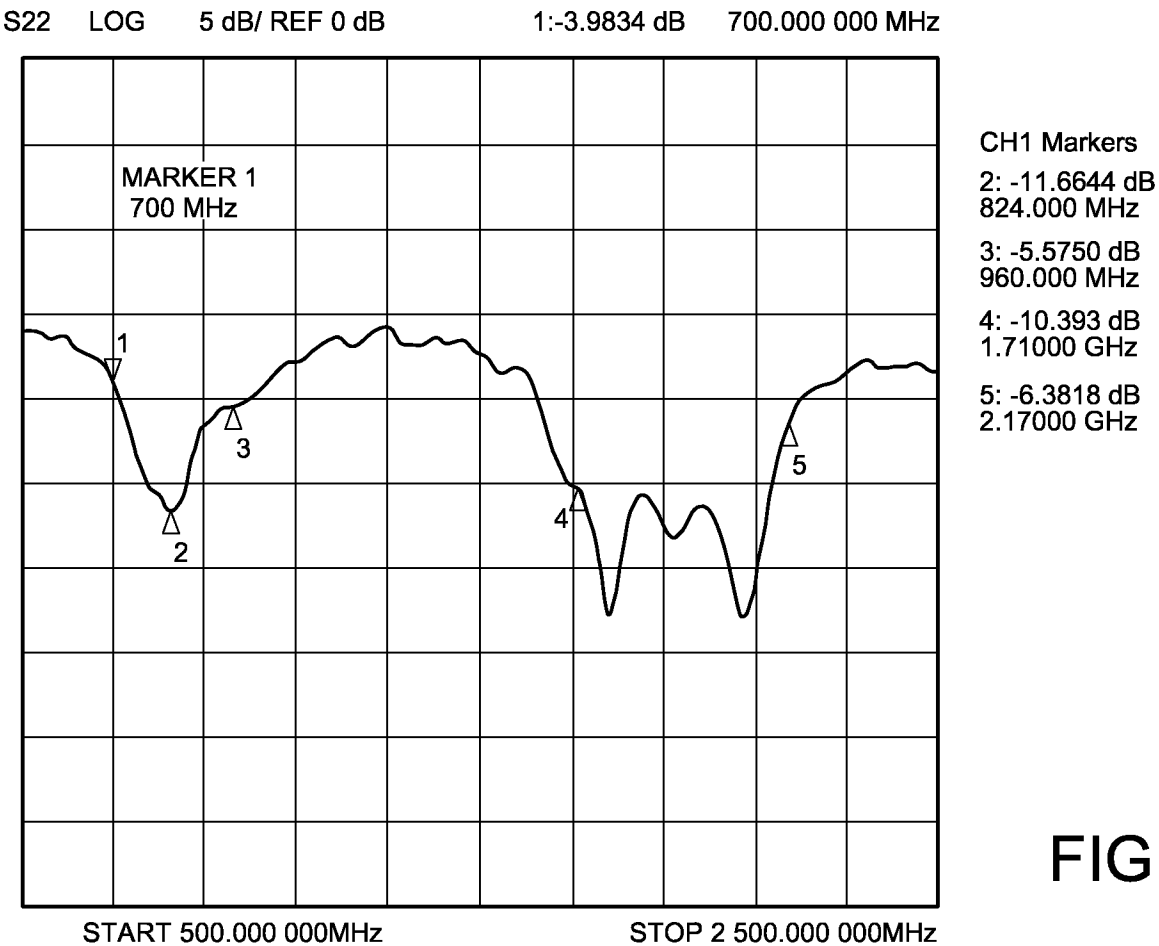
FIG. 8*a* shows a frequency response curve diagram of the present invention.
Figure 8B:
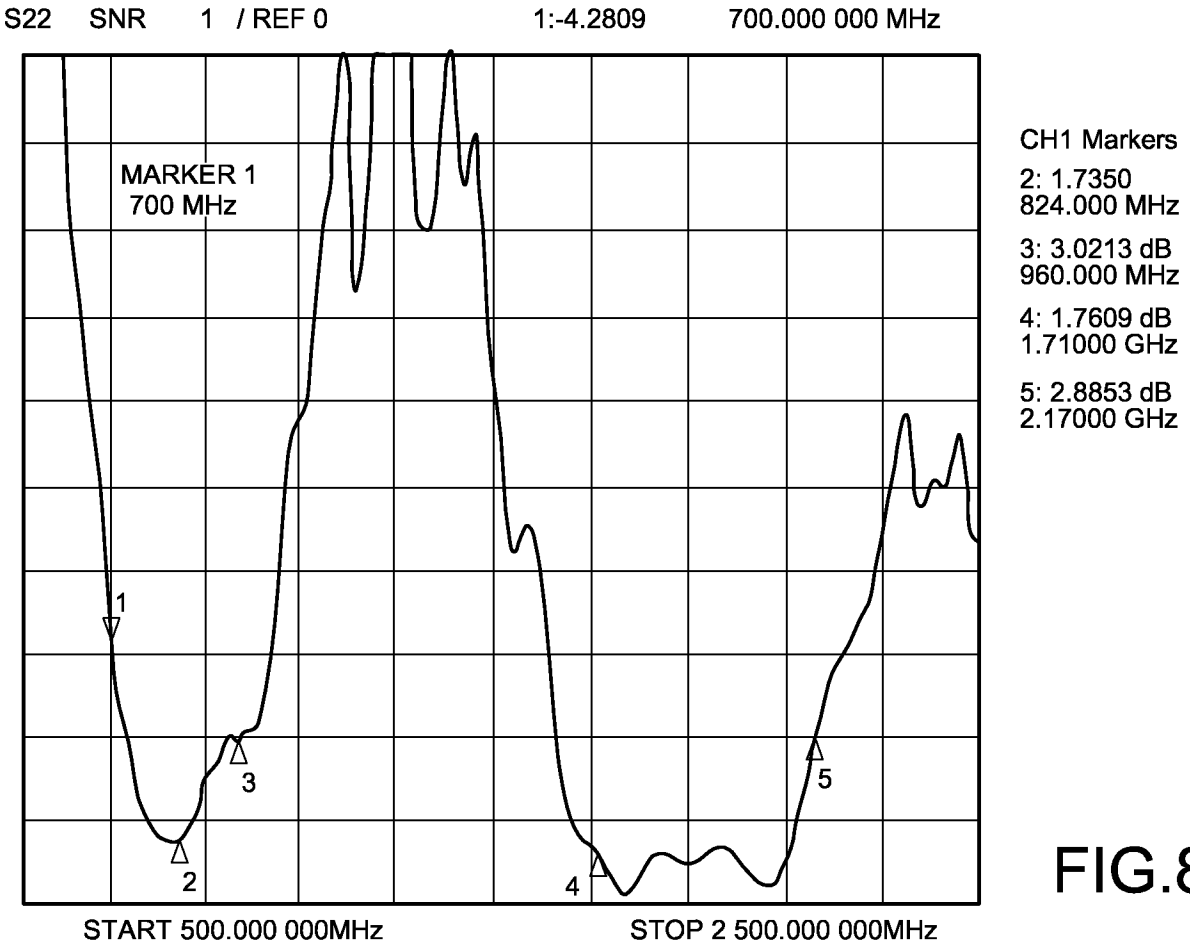
FIG. 8*b* shows another frequency response curve diagram of the present invention.

As FIGS. 8*a* to 8*c* show, when the multiple-band antenna module of this invention is operating at 700 MHZ, the return loss is −3.98, the standing wave ratio is 4.20.

When the multiple-band antenna module of this invention is operating at 824 MHZ, the return loss is −11.66, the standing wave ratio is 1.73.

When the multiple-band antenna module of this invention is operating at 960 MHZ, the return loss is −5.57, the standing wave ratio is 3.02.

When the multiple-band antenna module of this invention is operating at 1710 MHZ, the return loss is −10.39, the standing wave ratio is 1.76.

When the multiple-band antenna module of this invention is operating at 2170 MHZ, the return loss is −6.38, the standing wave ratio is 2.88.

FIG. 9 shows a peak gain parameter summary of the long term evolution (LTE) antenna of the present invention. This invention provides a compact-sized surface mount device antenna module for the long term evolution antenna technology and the fourth generation communication system. The antenna module covers the bands includes 700~960 MHZ and 171~2170 MHZ, which can be applied for long term evolution antenna, global system for mobile communications (GSM), digital communications system (DCS), personal communication system (PCS), wideband code division multiple access (WCDMA).

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A surface mount device multiple-band antenna module, comprising:

a substrate (1) having a first surface (11) and a second surface (12), the first surface (11) having two fixing points (18), a first grounding metal surface (13) and a first micro-strip line (14), an interval (15) being formed between the first grounding metal surface (13) and a first micro-strip line (14), the first grounding metal surface (13) having a second micro-strip line (16) connected thereto, the second micro-strip line (16) being parallel to the first micro-strip line (14), a space (17) being formed between the first micro-strip line (14) and the second micro-strip line (16);

a carrier (2) electrically connected to the substrate (1) and having a first radiative metal portion (21), a second radiative metal portion (22) and a third radiative metal portion (23), the second radiative metal portion (22) being electrically connected to the first radiative metal portion (21), the third radiative metal portion (23) being not electrically connected to the first radiative metal portion (21) and the second radiative metal portion (22), wherein the first radiative metal portion (21) and the second radiative metal portion (22) are formed on outer surfaces at opposite sides of the carrier (2), respectively;

wherein the first micro-strip line (14) is electrically connected to the joint of the first radiative metal portion (21) and the second radiative metal portion (22), and the third radiative metal portion (23) is electrically connected to the second micro-strip line (16), thereby, when a signal source (3) inputs through the first micro-strip line (14), and via the first radiative metal portion (21) and the second radiative metal portion (22) which respectively form a structure including high and low frequency resonance branches, the width of the space (17) between the first radiative metal portion (21) and the second radiative metal portion (22) is adjustable to fine tune a coupling capacitance therebetween, thus providing a high frequency resonance point by the first grounding metal surface (13), so as to increase the bandwidth, and wherein the two fixing points (18) are connected with the first radiative metal portion (21) and the second radiative metal portion (22) at opposite ends of a bottom surface of the carrier (2), respectively, and the location of one fixing point (18) connected with the first radiative metal portion (21) is other than the joint of the first radiative metal portion (21) and the second radiative metal portion (22) that is for connecting with the first micro-strip line (14).

2. The surface mount device multiple-band antenna module as claim 1, wherein the first micro-strip line (14) has a front section (141) and a rear section (142) and has a through hole (143), and the front section (141) extends into the first grounding metal surface (13), and the interval (15) is between the front section (141) and the first grounding metal portion (13).

3. The surface mount device multiple-band antenna module as claim 1, wherein the second surface (12) has a second grounding metal surface (19).

4. The surface mount device multiple-band antenna module as claim 3, wherein the carrier (2) is of rectangular cuboid shape and is made of ceramic material with high dielectric constant.

5. The surface mount device multiple-band antenna module as claim 4, wherein the first radiative metal portion (21), the second radiative metal portion (22) and the third radiative metal portion (23) each has different rectangular or stripe patterns.

6. The surface mount device multiple-band antenna module as claim 5, wherein the rectangular or stripe patterns are arranged on at least one surface of the carrier (2).

7. The surface mount device multiple-band antenna module as claim 6, further comprising a connector (4) having a shell (42) and a signal feeding probe (41) arranged inside the shell (42), wherein the signal feeding probe (41) passes through the through hole (143) of the first micro-strip line (14) and electrically connects to the first micro-strip line (14).

* * * * *